US006032417A

United States Patent [19]

Jakus et al.

[11] Patent Number: 6,032,417

[45] Date of Patent: Mar. 7, 2000

[54] CORNER LOCKING CARRIER SHOE FOR TILT SASH

[75] Inventors: Alan S. Jakus, Hemlock; Robert M. Lucci, Rochester; William P. Newton, Spencerport, all of N.Y.

[73] Assignee: Caldwell Manufacturing Company, Rochester, N.Y.

[21] Appl. No.: 08/914,624

[22] Filed: Aug. 19, 1997

Related U.S. Application Data

[63] Continuation-in-part of application No. 08/837,050, Apr. 11, 1997, abandoned.

[51] Int. Cl.[7] ..... E05D 15/22

[52] U.S. Cl. ..... 49/181; 49/176; 49/445; 16/197

[58] Field of Search ..... 49/176, 181, 182, 49/183, 445, 446; 16/197

[56] References Cited

U.S. PATENT DOCUMENTS

| | | | |
|---|---|---|---|
| 3,055,063 | 9/1962 | Peters . | |
| 4,452,012 | 6/1984 | Deal | 49/181 |
| 4,683,676 | 8/1987 | Sterner, Jr. | 49/176 |
| 4,854,077 | 8/1989 | Rogers et al. . | |
| 5,127,192 | 7/1992 | Cross | 49/181 |
| 5,243,783 | 9/1993 | Schmidt et al. | 49/176 |
| 5,353,548 | 10/1994 | Westfall . | |
| 5,371,971 | 12/1994 | Prete | 49/181 |
| 5,414,960 | 5/1995 | O'Donnell et al. | 49/181 |
| 5,452,495 | 9/1995 | Briggs | 49/181 |
| 5,806,243 | 9/1998 | Prete et al. | 49/181 |

*Primary Examiner*—Daniel P. Stodola
*Assistant Examiner*—Curtis A. Cohen
*Attorney, Agent, or Firm*—Eugene Stephens & Associates

[57] ABSTRACT

A tilt sash counterbalance system has a carrier shoe with a locking cam that moves a locking component to a corner-to-corner locking position within a shoe channel. This is done by moving the locking component to a locked position where the locking component simultaneously increases both the width and the thickness of the carrier shoe. This presses the locking component into one inside corner of the shoe channel while pressing an opposite edge of the carrier shoe in a diagonally opposite direction against a diagonally opposite inside corner of the shoe channel.

76 Claims, 7 Drawing Sheets

CORNER LOCKING CARRIER SHOE FOR TILT SASH

RELATED APPLICATIONS

This application is a Continuation-In-Part of parent application No. 08/837,050, filed Apr. 11, 1997, entitled Corner Locking Carrier Shoe for Tilt Sash, now abandoned.

TECHNICAL FIELD

Locking shoes for counterbalance systems for tilt window sash.

BACKGROUND

Many window sash counterbalance systems rely on locking of carrier shoes in place when a sash tilts. Otherwise, tilting a sash removes some of its weight from the counterbalance system, which would raise the sash shoes if they were not locked in place.

A multitude of arrangements have been devised for locking carrier shoes in place in shoe channels when a sash tilts. Many of these involve cams that are turned when the sash tilts so that the cams move locking elements that make the carrier shoe either wider or thicker so that it is no longer free to move vertically in a shoe channel.

Many such locking arrangements are problematic and not completely reliable. One difficulty with locking shoes is variations in the dimensions of the channels in which the shoes must lock. This can be caused by temperature and speed variations in the extrusion processes that form shoe channels. Any device for satisfactorily locking sash shoes must be able to accommodate the unavoidable variations in shoe channel dimensions. Another challenge is that shoe locks must often rely on an interengagement between low friction resinous materials of both the shoe and the channel. Finally, the cost of a shoe locking device is always an important factor, since window counterbalance systems are highly competitive in cost, as well as performance. In spite of the many suggestions for shoe locking arrangements, completely satisfactory and reliable locking systems remain elusive.

SUMMARY OF THE INVENTION

We have discovered that a more effective shoe locking force can be attained in a diagonally applied corner-to-corner direction within a shoe channel. We have found that an extruded resin shoe channel is stronger and more resistant to deflection from forces applied in a corner-to-corner direction than from forces applied in a side-to-side direction or a front-to-back direction, as is typically used in shoe locking systems.

To exploit this discovery, we have devised a carrier shoe with a cam and a locking element arranged to exert a corner-to-corner locking force diagonally across a shoe channel. This is done by making a locking element move to a locking position that enlarges both the width and thickness of the carrier shoe and presses the locking element against one corner of a shoe channel while pressing a diagonally opposite edge of the shoe against a correspondingly diagonally opposite corner of the shoe channel. We have also devised effective and low cost ways of achieving corner locking carrier shoes so that shoe locking is made reliable at an affordable price.

Our way of implementing a corner locking carrier shoe also provides an inexpensive way of accommodating a single basic shoe design to a range of shoe channel sizes.

This is done by substituting inexpensive shoe components of different sizes, such as different sizes of cams or follower locking elements. The different size components can be color coded and made visible from the sash side of the shoe so that tilting a sash and looking at a shoe within its shoe channel can indicate which dimension of component is being used.

Our corner locking carrier shoe also preferably accommodates a drop-in sash pin that can be lowered into a locked shoe from above or lifted upward out of a locked shoe. The sash pin can have a T-head that interlocks with a shoe wall to prevent the sash pin from pulling out of the shoe if the window is bowed or suitcased at a construction site.

DRAWINGS

FIGS. 1–5 schematically show the basic operation of a corner locking carrier shoe according to our invention. More particularly, FIG. 1 is a schematic elevational view of a bottom portion of a preferred carrier shoe schematically indicating counterbalances that can be connected to the shoe to exert counterbalance lifting force.

FIG. 2 is an elevation similar to the view of FIG. 1, but showing the shoe in a locked condition.

FIGS. 3 and 4 schematically and respectively show the shoe of FIGS. 1 and 2 in unlocked and locked conditions.

FIG. 5 schematically shows the shoe of FIGS. 1–4 arranged within a shoe channel in a locked condition exerting corner-to-corner locking force.

FIGS. 6–9 partially schematically show a lower region of a preferred embodiment of our corner locking carrier shoe. More specifically, FIG. 6 shows a rear elevation of a shoe in unlocked condition and FIG. 7 shows a rear elevation similar to the view of FIG. 6, with the shoe in locked condition.

FIGS. 8 and 9 are partially schematic, cross-sectional views taken respectively along the lines 8—8 of FIG. 6 and 9—9 of FIG. 7.

DETAILED DESCRIPTION

Figure 1:
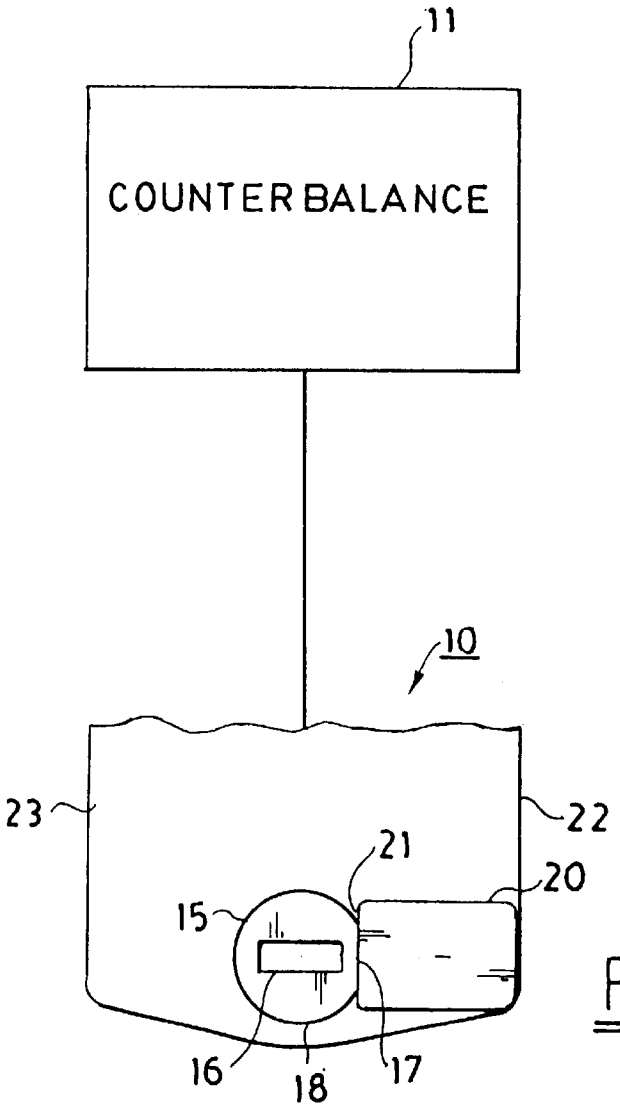
Figure 2:
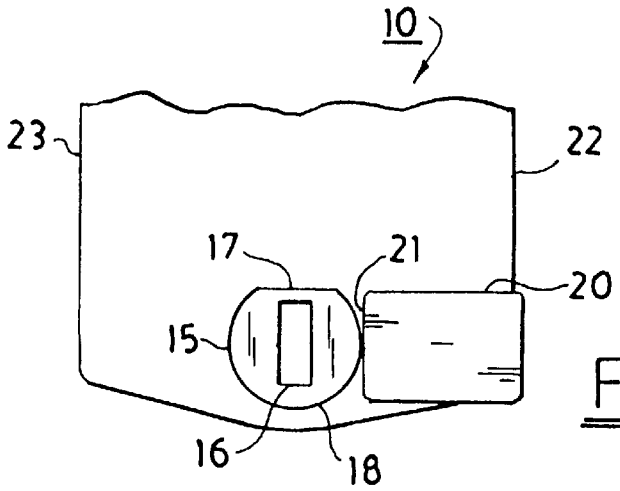
Figure 3:
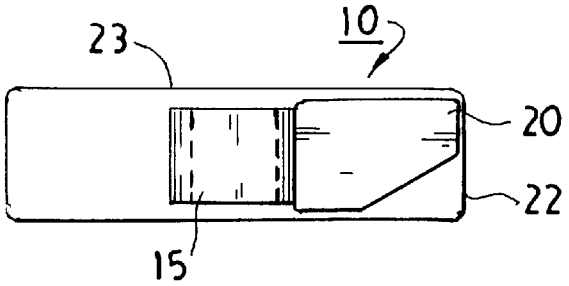

The basic operation of one preferred embodiment of our corner locking carrier shoe is shown in a schematic and simplified way in FIGS. 1–5. Shoe 10, as illustrated in FIG. 1, has its upper portion cut away and a schematic representation of counterbalances 11 that can be combined with shoe 10 to exert an uplifting force that counteracts sash weight. Possible counterbalances 11 include a block and tackle system, a torsion balance, a constant force curl spring, and an extension spring. Counterbalances 11 are also not exhaustive of the possibilities and show that shoe 10 is not limited to any one type of counterbalance.

A cam 15 having a sash pin receiver slot 16 is arranged in shoe 10 so that cam 15 turns when a sash tilts. A cam follower 20 serves as a shoe locking element when actuated by cam 15. A low cam profile 17 engages follower lock 20 in an unlocked position shown in FIG. 1. When a sash tilts, cam 15 turns to the position illustrated in FIG. 2, which moves a higher profile cam surface 18 against a follower surface 21 of lock 20 to move lock 20 to a locked position illustrated in FIG. 2.

Figure 4:
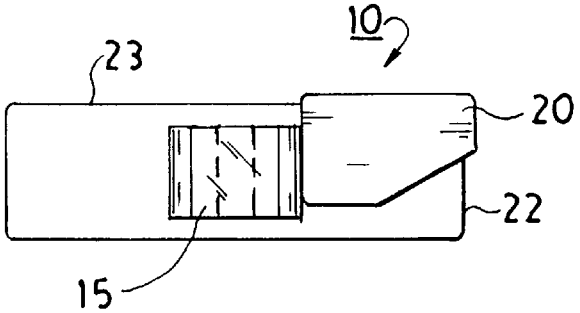
Figure 5:
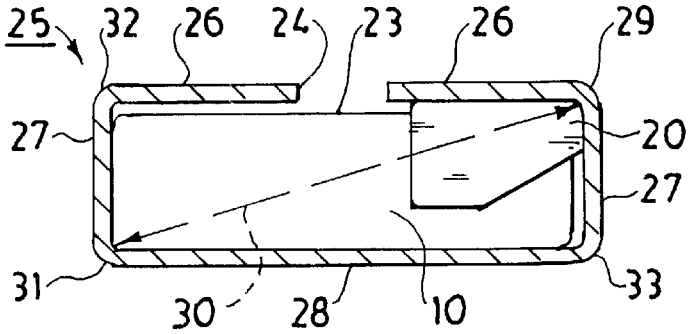

In the locked position, as further shown in FIGS. 4 and 5, element 20 extends beyond a side 22 of shoe 10 to increase the width of shoe 10 in a side-to-side direction and also extends beyond a face surface 23 to make shoe 10 thicker in a front-to-back direction. This simultaneously enlarges both the width and the thickness of shoe 10 and thereby increases a diagonal dimension of the shoe, from one side edge to a diagonally opposite side edge.

The corner locking effect of enlarging both the width and thickness of shoe 10 is shown in FIG. 5, where shoe 10 is illustrated as disposed within the generally rectangular walls of a shoe channel 25. Channel 25 has a slot 24 extending vertically along its sash side so that a sash pin can reach through slot 24 and engage shoe 10. Otherwise, channel 25 is generally enclosed within front or sash side walls 26 on opposite sides of slot 24, side or end walls 27, and back or rear wall 28.

Lock 20 in the locked position shown in FIG. 5 applies a shoe locking force in a corner-to-corner direction as shown by arrowheads connected by a broken line 30. Lock 20 presses against the inside of forward channel corner 29 and exerts an opposite force pressing shoe 10 against diagonally opposite rear channel corner 31. The corner-to-corner locking force can be changed in direction and applied between inside forward channel corner 32 and rear side corner 33. Either way, the locking enlargement of a diagonal dimension of shoe 10 by an increase in both thickness and width applies locking force between diagonally opposite channel corners of the interior space within shoe channel 25.

We have found by testing many extruded resin shoe channels that channel strength and resistance to deformation are generally greater in a corner-to-corner direction than in either a front-to-back direction or side-to-side direction. Making follower lock 20 move obliquely into one inside corner of channel 25 so as to exert a corner-to-corner locking force takes advantage of this discovery and provides a more secure lock than is obtainable with carrier shoes that enlarge in only one direction for locking purposes.

Figure 6:
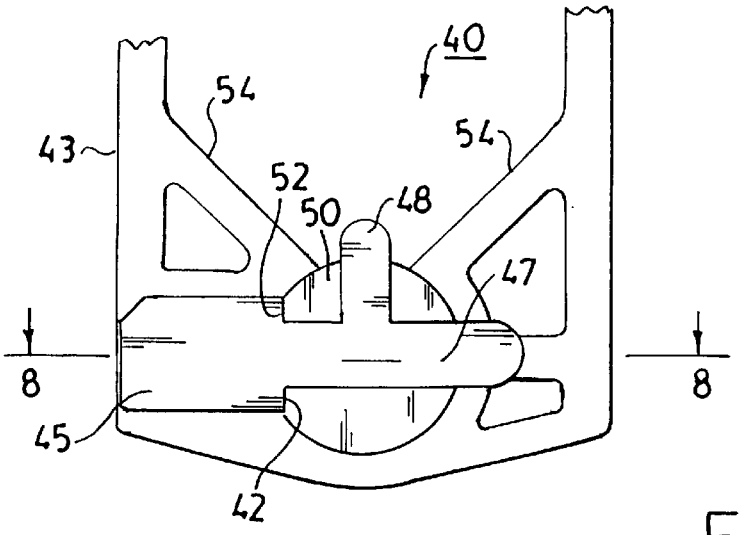
Figure 7:
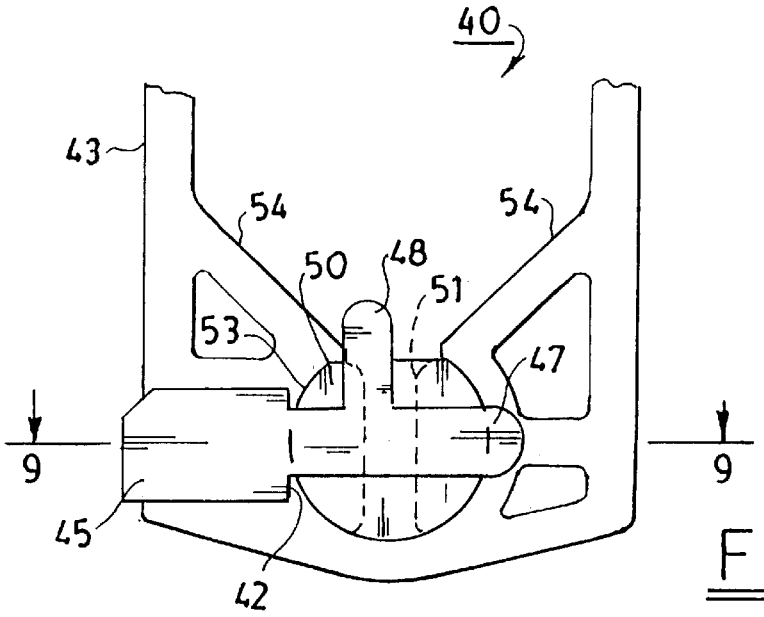
Figure 13:
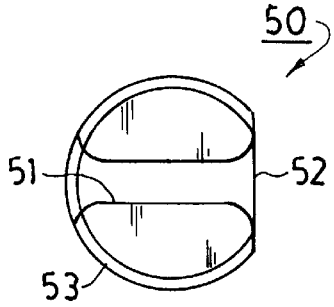
FIG. 13 is a front elevational view of a cam usable in the shoes of FIGS. 6–11.
Figure 14:
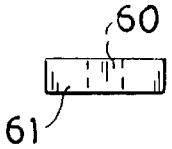
FIGS. 14 and 15 are respectively front and side elevational views of a T-head sash pin usable with the cam of FIG. 13.
Figure 15:
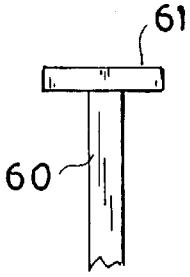

More detail for a preferred embodiment of a carrier shoe that accomplishes a corner-to-corner lock according to our invention appears in FIGS. 6–11. FIGS. 6 and 7 show the rear side of a corner locking carrier shoe 40 having a follower locking element 45 and a locking cam 50. A front face of cam 50 is illustrated in FIG. 13 as having a slot 51 that receives a sash pin. Slot 51 preferably extends all the way across cam 50 so that slot 51 is open at each of its opposite ends. When the cam is in the locked position illustrated in FIG. 7, a sash pin can be lifted up out of cam 50 and withdrawn from shoe 40 as a sash is removed from a window. Conversely, a sash pin can be lowered back down into slot 51 as a sash is returned to a supported position between a pair of carrier shoes 40. To facilitate such a "lift-off" process, a central region of shoe 40 above cam 50 is left open and unobstructed. Having slot 51 open at both ends allows a single cam 50 to be operated in either a right hand or left hand shoe, where it can rotate in either direction as a sash tilts. Slot 51 also preferably has flared end regions to help receive a sash pin being lowered into cam 50. Also, surfaces 54 of shoe 40 are preferably inclined downward toward the flared ends of slot 51 when cam 50 is in a locked position so that a sash pin being lowered into shoe 40 is guided into slot 51 by shoe surfaces 54.

Figure 11:
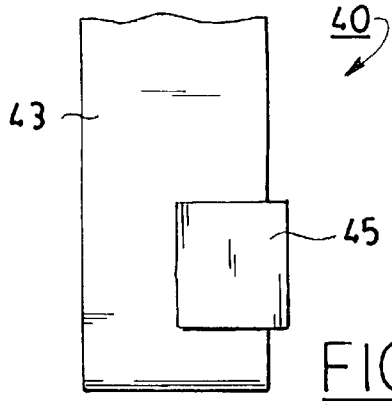
Figure 12:
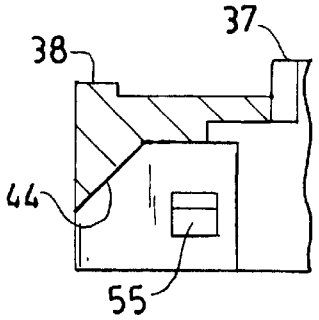
FIG. 12 is a left side fragment of the view of FIG. 8 showing the locking element removed to reveal how it interconnects with a shoe body.

In the unlocked position shown in FIG. 6, follower lock 45 is withdrawn to within the surface boundaries of shoe 40, and a low profile surface 52 of cam 50 engages a follower surface 42 of lock element 45. In the locked position of FIG. 7, a higher profile cam surface 53 engages follower surface 42 and forces lock element 45 into the locked position, which is also illustrated in FIGS. 9 and 11.

Figure 8:
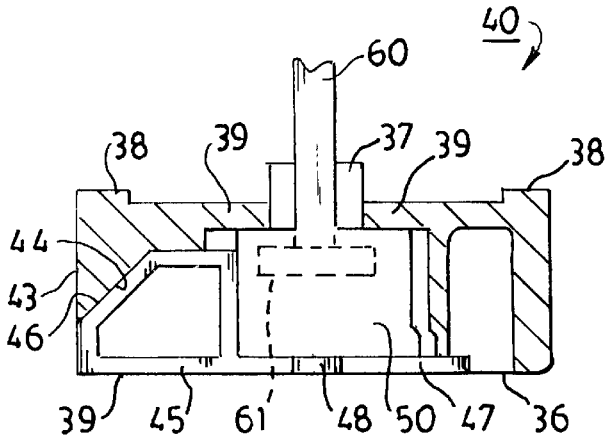

To accomplish corner-to-corner locking, shoe 40 provides an inclined plane 44 that is engaged by a ramp surface 46 on follower locking element 45. Inclined plane 44 is oblique to the generally rectangular cross-sectional shape of shoe 40, as shown in FIGS. 8 and 9, and is preferably angled at about 45° to side edge 43 and rear face surface 36 of shoe 40. This causes locking element 45 to move obliquely along a path established by inclined plane 44, as ramp surface 46 slides along plane 44. This oblique movement accomplishes the simultaneous widening and thickening of shoe 40, as best shown in FIG. 9.

Figure 9:
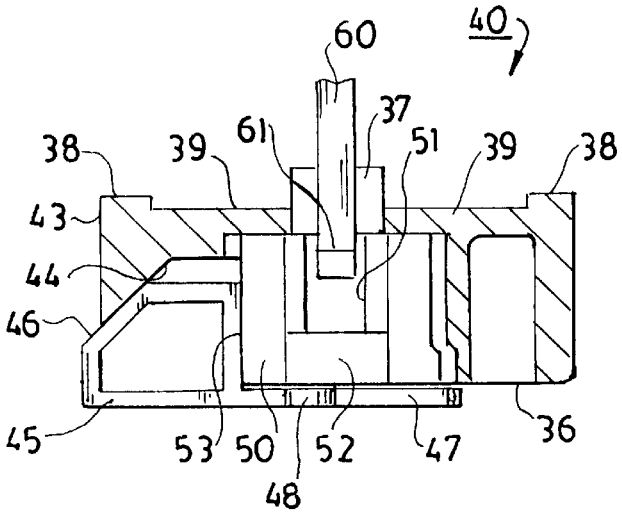
Figure 10:
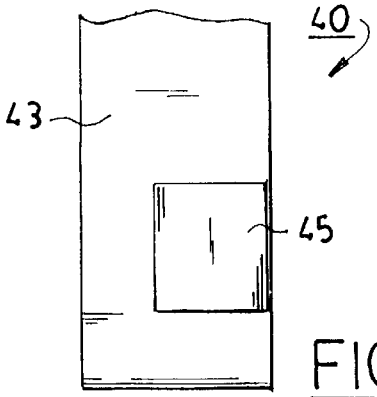
FIGS. 10 and 11 are partially schematic, side elevational views of the shoes of FIGS. 6–9 respectively showing an unlocked condition in FIG. 10 and a locked condition in FIG. 11.

FIGS. 8 and 9 also illustrate a sash pin 60 having a T-head 61 lodged in slot 51 of cam 50. Pin 60 can extend through slot 24 of shoe channel 25 (illustrated in FIG. 5) and, in the locked position shown in FIG. 9, can be raised up out of slot 51 or lowered back into slot 51 for removing or replacing a window sash. When shoe 40 is unlocked, as shown in FIG. 8, slot 51 in shoe 50 is horizontal, and T-head 61 is held within shoe 40 by shoe front walls 39. Walls 39 also retain cam 50 from moving toward a forward face 38 of shoe 40. Walls 39 keep sash pin 60 locked within shoe 40 whenever the shoe is unlocked and thus prevent accidental withdrawal of pin 60 if the window is bowed to increase the distance between opposite shoes 40, as can happen during carrying of a window at a construction site in suitcase fashion.

Shoe 40 and cam 50 are not limited to operation with headed sash pins, however. Sash pins without heads can also be used in shoe 40. To help prevent accidental withdrawal of an unheaded sash pin from shoe 40, in response to bowing a window jamb, a pin support surface 37 extends to the forward face 38 of shoe 40 in a position even with a pin supporting surface of cam 50. Support surface 37 allows an unheaded pin 60 to be withdrawn from cam 50 as far as the reach of surface 37 without falling out of engagement with shoe 40. Such a withdrawn pin remains supported by surface 37 in a position to slide back into cam 50.

Follower lock 45 has a rear face extension 47 that reaches over and beyond the location of cam 50. By means of rear extension surface 47, lock 45 retains cam 50 in place within shoe 40. Rear lock surface 47 also extends across the rear face 36 of shoe 40 to have a broad fitting engagement with a rear wall of a shoe channel.

Figure 16:
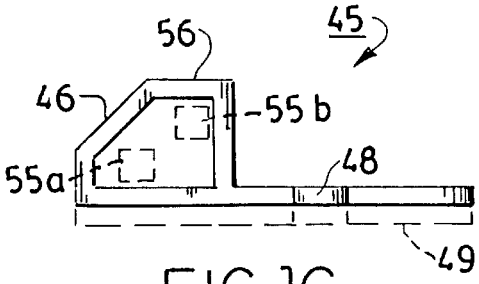
FIG. 16 is an elevational view of the locking element shown in the shoes of FIGS. 6–11.
Figure 17:
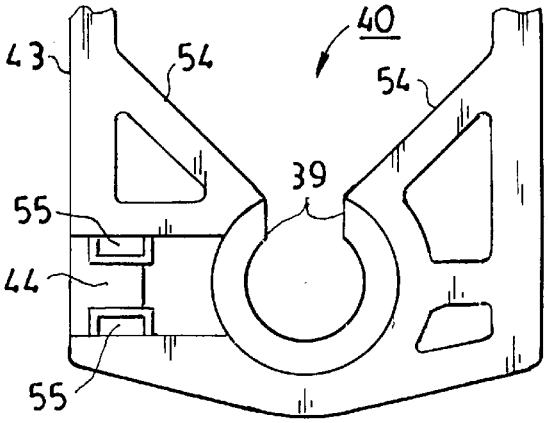
FIG. 17 is a rear elevation similar to the views of FIGS. 6 and 7, but showing a carrier shoe with a cam and locking element removed.
Figure 18:
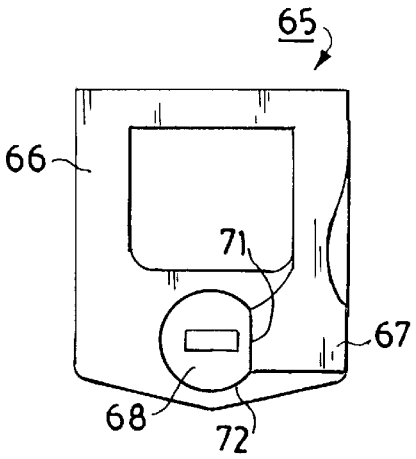
FIGS. 18 and 19 are partially schematic, front elevational views of another preferred embodiment of a corner locking carrier shoe shown respectively in unlocked and locked positions.

Follower lock 45, which is also shown in FIG. 16, is preferably snapped into assembled position in shoe 40. To accomplish this, an opposed pair of lock projections are formed in shoe 40 so that interior leading edges 56 of follower lock 45 can snap over and interlock with projections 55. Leading edges 56 are preferably beveled for this purpose, and interlocks 55 are correspondingly tapered to accomplish such a snap fit. Once follower 45 is snapped into assembled position within shoe 40, where it retains cam 50, it is movable freely throughout a range of movement permitted by cam 50 and interlocks 55.

This range of movement is illustrated by different broken line positions of lock projections 55 relative to locking element 45 in FIG. 16. When lock 45 is retracted within shoe 40 as far as cam 50 will allow, its position relative to the lock projection is shown by the broken line position 55*a*. Outward movement of lock 45 to a lock position is limited by the lock projection in a broken line position 55*b*. Lock projections 55 remain fixed in shoe 40, of course, so that apparent movement of lock projection 55 between positions 55*a* and 55*b* in FIG. 16 is intended to represent possible and actual movement of lock element 45.

FIG. 16 also shows, by broken line 49, that follower 45 can be made in different thicknesses. This is advantageous for accommodating a single size of shoe 40 to varying dimensions of shoe channels 25. Lock 45 can be made with several different thicknesses, represented by rearward thickening 49, to fit the inevitably varying dimensions of different shoe channels 25. Follower 45 is preferably molded of resin material and formed as a relatively inexpensive part that can easily change the locking dimensions of shoe 40.

Different sizes of follower locks 45 are also preferably color coded to indicate the particular size of lock 45 being used. To make the color, and therefore the size, of follower 45 readily visible from the sash side of shoe 40, rearward extension 47 has a vertical projection 48 that extends above the upper surface of cam 50. By tilting a sash and looking through channel slot 24 at shoe 40 within channel 25, a serviceman can identify by the color of projection 48 which size of follower 45 is installed in shoe 40.

Another preferred embodiment of corner locking carrier shoe 65, as shown in FIGS. 18–23, illustrates the use of a flexible shoe body element to achieve a corner locking effect. Shoe 65 has a body 66 that is molded to form an element 67 that is flexible and resiliently movable relative to the rest of body 66. Movement of element 67 is accomplished by cam 68, which is turned by a sash pin 69 as a sash tilts.

Movable lock element 67 is preferably arranged near a corner or edge of shoe body 66 so it is in a proper position for exerting a corner-to-corner locking force when moved by cam 68. There are many other ways that a shoe body 66 can be configured to allow flexible movement of a locking element 67. Also, since counterbalance shoes are often molded of resin material that is inherently flexible, no special compositions are required to make lock 67 resiliently movable.

Figure 21:
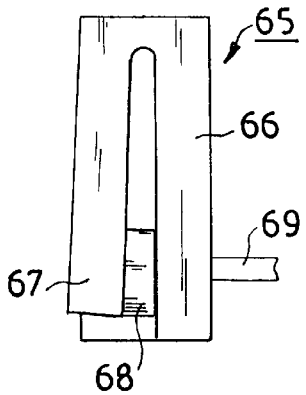
Figure 22:
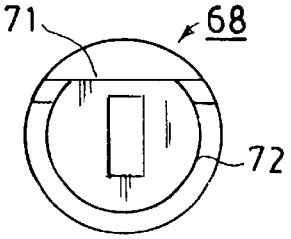
FIG. 22 is a front elevational view of a preferred embodiment of a cam for use in the shoe of FIGS. 18–21.
Figure 23:
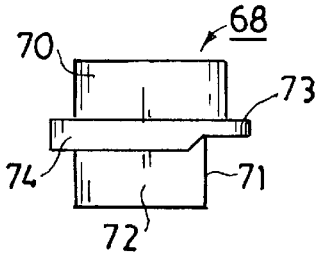
FIG. 23 is a side elevational view of the cam of FIG. 22.
Figure 24:
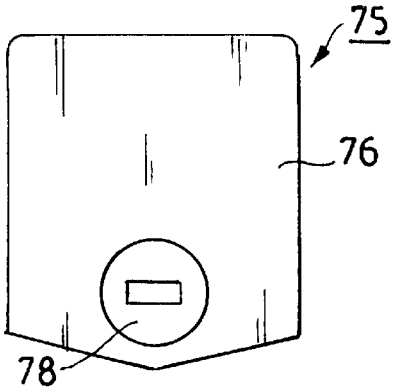
FIGS. 24 and 25 are partially schematic, front elevational views of another preferred embodiment of a corner locking carrier shoe shown respectively in unlocked and locked positions.

Instead of using an inclined plane to guide movement of shoe component 67 in a direction that enlarges both shoe width and shoe thickness, the necessary movement is accomplished by cam 68, in the embodiment of FIGS. 18–23. To achieve this, cam 68 has high and low profile surfaces that change both axial and radial dimensions of cam 68 as a sash tilts. In a radial plane, as best shown in FIG. 22, cam 68 has a low profile surface 71 that allows follower 67 to move to the unlocked position of FIGS. 18 and 20 and a high profile surface 72 that moves follower 67 to the locked position of FIGS. 19 and 21. In an axial plane, as best shown in FIG. 23, cam 68 has a low profile surface 73 that allows lock 67 to move to the unlocked position of FIGS. 18 and 20 and a high profile surface 74 that moves lock 67 to the locked position of FIGS. 19 and 21.

Figure 19:
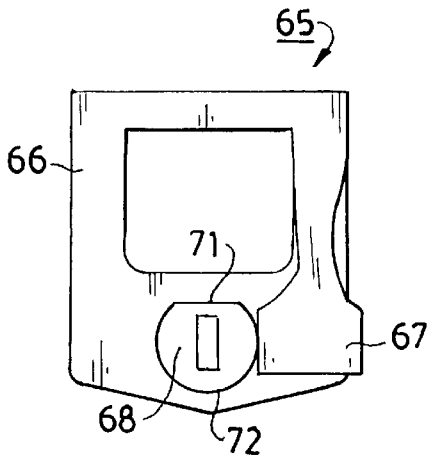
Figure 20:
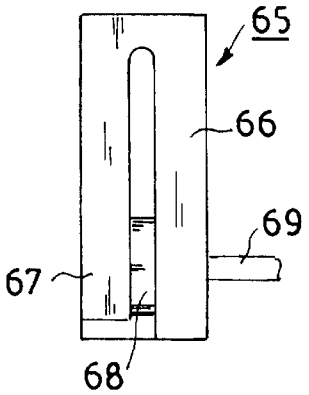
FIGS. 20 and 21 are partially schematic, side elevational views of the shoe of FIGS. 18 and 19 shown respectively in unlocked and locked positions.

Radial high profile surface 72 moves element 67 laterally, as shown in FIG. 19, to increase the width of shoe body 66; and axial high profile surface 74 moves element 67 transversely to increase the thickness of shoe 65, as shown in FIG. 21. High profile surfaces 72 and 74 operate simultaneously to move locking element 67 to a locking position when a tilting sash rotates sash pin 69. Conversely, as sash pin 69 follows a sash back to an upright position, low profile surfaces 71 and 73 allow element 67 to withdraw to the unlocked position shown in FIGS. 18 and 20. A cylindrical hub 70 of cam 68 is housed for rotation in shoe body 68 for keeping the movement of profile surfaces 71–74 concentric.

Another preferred embodiment of a corner-to-corner locking shoe 75 is shown in FIGS. 24–29. Shoe 75 is preferably formed in two parts or components 76 and 77 that enclose or contain a cam 78 and possibly also a counterbalance spring (not shown) or a connection to a counterbalance spring. An example of such a shoe is disclosed in detail in U.S. Pat. No. 5,353,548, which is incorporated herein by reference. Body portions 76 and 77 are also made resilient, flexible, or movable relative to each other, which can readily be a characteristic when shoe body parts 76 and 77 are molded of resin material, as preferred.

Figure 25:
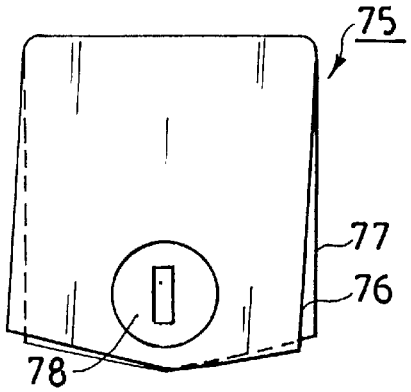
Figure 26:
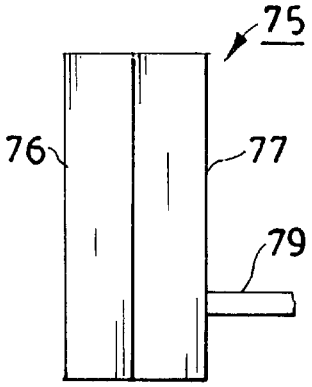
FIGS. 26 and 27 are partially schematic, side elevational views of the shoe of FIGS. 24 and 25 shown respectively in unlocked and locked positions.
Figure 27:
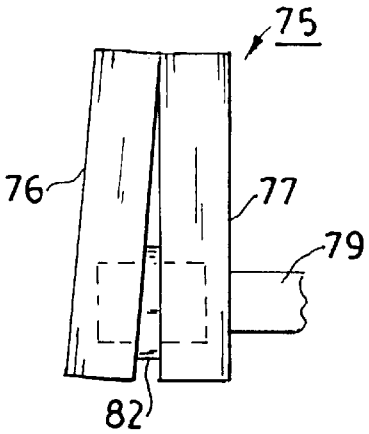
Figure 28:
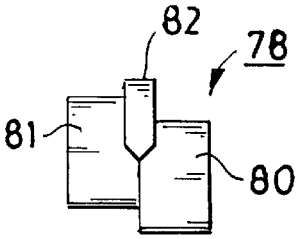
FIG. 28 is a partially schematic, side elevational view of a cam for use in the shoe of FIGS. 24–27.
Figure 29:
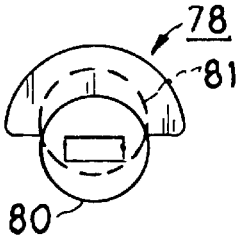
FIG. 29 is a front elevational view of the cam of FIG. 28.

Instead of a follower lock or locking element that moves to a locking position relative to the rest of a shoe body, components 76 and 77 move relative to each other in both width and thickness directions while otherwise serving as portions of shoe 75. Lateral displacement of bodies 76 and 77 in a shoe width direction for locking purposes is shown in FIG. 25, and transverse displacement of bodies 76 and 77 in a shoe thickness direction for locking purposes is shown in FIG. 27. Such width and thickness displacements preferably occur simultaneously as cam 78 rotates in response to a pin 79 connected to a tiltable sash.

Cam 78 includes a cylindrical hub 80 that is housed in one of the shoe body parts 76 and 77 to establish an axis of rotation. Otherwise, cam 78 has profiles that vary both radially and axially so that cam rotation moves body parts 76 and 77 from the unlocked positions of FIGS. 24 and 26 to the locked positions of FIGS. 25 and 27.

A radial profile of cam 78 is made variable by a cylinder 81 that is eccentric to hub cylinder 80. Eccentric cylinder 81 is housed in one of the body parts 76 and 77, while hub 80 is housed in the other body part. Then, as cam 78 turns in response to sash pin 79, eccentric cylinder 81 moves body parts 76 and 77 laterally to the locked position shown in FIG. 25.

In an axial direction, cam 78 has a high profile surface 82 that separates shoe parts 76 and 77 in a thickness direction, as shown in FIG. 27. Eccentric cylinder 81 and high profile surface 82 are arranged to operate simultaneously so that as shoe parts 76 and 77 move to the locked position of FIG. 25, they also move to the locked position of FIG. 27. This increases a diagonal dimension between opposite edges of shoes 75 to accomplish corner-to-corner locking.

Many variations can be made in implementing the corner-to-corner shoe locking effect of our invention. A carrier shoe involves a multitude of design considerations that can be varied within the basic operating principle of moving a locking component to simultaneously increase the width and thickness of a carrier shoe.

We claim:

1. In a tilt sash counterbalance system having a carrier shoe running vertically in a shoe channel and carrying a cam engaged by a sash pin to move a follower that locks the shoe in the shoe channel when a sash tilts, the improvement comprising:

the cam and follower are arranged so that the follower moves from an unlocked position along a path that is diagonal to the shoe and to the shoe channel until the follower reaches a locking position in which the follower presses into an inside corner of the shoe channel while pressing the shoe into a diagonally opposite inside corner of the shoe channel so that the follower in the locking position exerts locking force applied between diagonally opposite inside corners of the shoe channel.

2. The improvement of claim 1 wherein the diagonal path of movement follows an inclined plane formed in the shoe and engaged by a ramp surface of the follower.

3. The improvement of claim 1 wherein the follower is trapped in the carrier shoe from movement beyond a maximum extension of the locking position.

4. The improvement of claim 1 wherein the follower is arranged near a corner of the shoe.

5. The improvement of claim 1 wherein the follower is formed as a flexible portion of the shoe.

6. The improvement of claim 1 wherein the shoe is divided into two portions that are movable relative to each other, and one of the portions serves as the follower.

7. The improvement of claim 1 wherein the cam has surfaces that move the follower both radially and axially of the cam to accomplish the diagonal path of movement.

8. The improvement of claim 1 wherein the cam has a surface that moves the follower radially of the cam when the sash tilts, and the follower moves axially of the cam along an inclined shoe surface as the sash tilts.

9. The improvement of claim 1 wherein a free end of the sash pin has an interlock that engages a wall of the shoe confronting the sash and prevents the sash pin from escaping from the shoe when the sash is untilted.

10. The improvement of claim 1 wherein the follower is available in different dimensions combinable with the shoe and cam so that changing only the follower accommodates different diagonal dimensions of shoe channels.

11. The improvement of claim 10 wherein the follower is visible from a sash side of the shoe, and different sizes of follower locks are color coded.

12. The improvement of claim 1 wherein the sash pin is removable upward from the locked shoe and is insertable downward into the locked shoe.

13. The improvement of claim 1 wherein a sash side of the shoe has a pin-engaging surface aligned with a pin-receiving recess of the cam for engaging a sash pin that withdraws from the cam.

14. A locking carrier shoe for a system counterbalancing a tilt sash, the shoe comprising:

a locking element of the shoe being movable along a path that is diagonal between a pair of shoe corners defined by opposite face and side surfaces of the shoe so that movement of the locking element to a locking position moves the locking element along the diagonal path so that the locking element extends beyond unlocked positions of both a face and a side surface of the shoe meeting at a shoe corner to enlarge a locked dimension of the shoe in the diagonal direction of the path of movement.

15. The shoe of claim 14 wherein movement of the locking element along the diagonal path is motivated by a cam that rotates in the shoe when the sash tilts.

16. The shoe of claim 15 wherein the locking element engages and follows both radial and axial cam profiles that produce the diagonal movement.

17. The shoe of claim 15 wherein the cam moves the locking element along an incline formed on a shoe surface.

18. The shoe of claim 15 wherein the locking element is confined within the shoe for limited movement along the diagonal path and retains the cam within the shoe.

19. The shoe of claim 14 wherein the locking element is a flexible portion of the shoe.

20. The shoe of claim 14 combined with a shoe channel so that in the locking position the locking element and the shoe engage and exert pressure against diagonally opposite inside corners of the shoe channel.

21. The shoe of claim 14 combined with a sash and a sash pin so that in a locked position of the shoe and a cam within the shoe, the sash pin is free to move upward out of the shoe and downward into the shoe.

22. The shoe of claim 21 wherein the sash pin is configured with an interlock that prevents the sash pin from escaping from the shoe except when the shoe is in the locked position.

23. The shoe of claim 14 wherein the locking element is available in different sizes to accommodate different diagonal dimensions of channels for the shoe.

24. The shoe of claim 23 wherein different sizes of the locking element are color coded, and the locking element is visible from a sash side of the shoe.

25. The shoe of claim 14 wherein the shoe is divided into two parts, one of which holds the cam and another of which comprises the follower.

26. A method of locking a tilt sash counterbalance shoe in a shoe channel in response to tilting of the sash, the method comprising:

a. arranging a lock to move along a path of movement in response to a cam housed in the shoe, the movement path being diagonal to shoe corners between face and side surfaces of the shoe and therefor oblique to both the face and the side surfaces of the shoe; and b. moving the lock along the oblique path when the sash tilts to press the lock into a locking position in which the lock extends beyond both a face and an adjoining side surface at a corner of the shoe to engage an inside corner of the shoe channel while pressing an opposite shoe corner against a diagonally opposite inside corner of the shoe channel to exert corner-to-corner locking pressure holding the shoe within the shoe channel.

27. The method of claim 26 including limiting the movement of the lock along the path so that the lock cannot escape from the shoe.

28. The method of claim 26 including using the lock to retain the cam within the shoe.

29. The method of claim 26 including interlocking a free end of a sash pin within the shoe when the shoe is unlocked.

30. The method of claim 26 including using different sizes of locks to accommodate different diagonal dimensions of shoe channels.

31. The method of claim 30 including color coding the different sizes of locks and arranging the color coded locks to be visible from a sash side of the shoe.

32. The method of claim 26 including forming the lock as a flexible portion of the shoe.

33. The method of claim 26 including using both radial and axial cam surfaces to move the lock along the oblique path.

34. The method of claim 26 including using an incline on the shoe to establish the obliqueness of the path.

35. A shoe locking system for a counterbalance for a tilting sash, the locking system including a sash shoe, a shoe channel in which the shoe moves vertically, and a shoe cam engaged by a pin of the sash, the shoe locking system comprising:

a. a lock being moved by the cam to a locking position in which an edge between face and side surfaces of the lock extends beyond unlocked positions of respective face and side surfaces of the shoe so that the lock in the locking position extends beyond an unlocked diagonal dimension of the shoe and presses the edge of the lock against an inside corner of the shoe channel to press a diagonally opposite edge of the shoe against a diagonally opposite inside corner of the shoe channel; and b. the lock being moved to the locking position along a path that is oblique to both side and face surfaces of the shoe.

36. The system of claim 35 wherein the lock is confined in the shoe for limited movement along the path.

37. The system of claim 35 wherein the path is established by an inclined plane of the shoe engaged by a ramp surface of the lock.

38. The system of claim 35 wherein the lock is arranged near a corner of the shoe.

39. The system of claim 35 wherein the lock is formed as a flexible portion of the shoe.

40. The system of claim 35 wherein the shoe is formed of two portions that are movable relative to each other, and one of the portions serves as the lock.

41. The system of claim 35 wherein the cam has surfaces for moving the lock both radially and axially of the cam to reach the locking position via the oblique path.

42. The system of claim 35 wherein the lock retains the cam in the shoe.

43. The system of claim 42 wherein the lock extends across a rear face of the cam opposite the sash.

44. The system of claim 43 wherein different thicknesses of the lock adjust the shoe to different dimensions of shoe channels.

45. The system of claim 35 wherein the cam and the shoe are configured to allow the sash pin to move upward out of the shoe and downward into the shoe when the shoe is locked.

46. The system of claim 35 wherein a free end of the sash pin has an interlock that engages a wall of the shoe confronting the sash and prevents the sash pin from withdrawing from the shoe in a sash direction.

47. A locking shoe combined with a counterbalanced tilt sash, the locking shoe moving vertically with the sash in a shoe channel, and the locking shoe having a cam engaged by a pin of the tilt sash for moving a follower to a shoe locking position when the sash tilts, the locking shoe comprising:

the shoe locking position being arranged so that the follower moves obliquely along a diagonal path between corners of adjoining face and side surfaces of the shoe and extends beyond a maximum unlocked diagonal dimension between the corners of the shoe to extend beyond both a face and an adjoining side surface of the shoe to exert shoe locking pressure by pressing the follower into an inside corner of the shoe channel and pressing the shoe into a diagonally opposite inside corner of the shoe channel.

48. The locking shoe of claim 47 wherein the follower has a ramp surface engaging an inclined plane in the shoe so that the follower moves to the shoe locking position beyond a corner edge between face and side surfaces of the shoe.

49. The locking shoe of claim 47 wherein the cam has both radial and axial follower-engaging surfaces that move the follower along the diagonal dimension as the sash tilts.

50. The locking shoe of claim 47 wherein the follower is a flexible portion of the shoe.

51. The locking shoe of claim 47 wherein the shoe is divided into two portions, one of which holds the cam and another of which comprises the follower.

52. The locking shoe of claim 47 wherein the follower is configured for retaining the cam within the shoe.

53. The locking shoe of claim 52 wherein the follower extends across a rear face of the cam opposite the sash.

54. The locking shoe of claim 53 wherein the follower is available in different dimensions combinable with the shoe to fit the shoe to different dimensions of shoe channels.

55. The locking shoe of claim 47 wherein the shoe and cam are configured so that in the locking position, the sash pin can move upward out of the shoe and downward into the shoe.

56. The locking shoe of claim 47 wherein a free end of the sash pin is formed with an interlock that prevents the sash pin from withdrawing from the shoe when the shoe is unlocked.

57. The locking shoe of claim 47 wherein a sash side of the shoe has a pin support surface aligned with a pin support surface of the cam for supporting a sash pin that is withdrawn from the cam.

58. A method of locking a tilt sash shoe running vertically in a shoe channel and carrying a cam engaging a pin connected to the tilt sash, the method comprising:

moving a follower in response to cam movement when the sash tilts so that the follower moves obliquely within the shoe channel along a path that is diagonal between corners defined by face and side surfaces of the shoe to a locking position extending along and beyond a maximum unlocked diagonal dimension of the shoe to press the follower against an inside corner of the shoe channel and press the shoe against a diagonally opposite inside corner of the shoe channel for locking the shoe against vertical movement within the shoe channel.

59. The method of claim 58 including retaining the follower within the shoe for limited movement in response to the cam.

60. The method of claim 59 including using the follower to retain the cam within the shoe.

61. The method of claim 58 including moving a ramp surface of the follower along a shoe surface inclined to establish the oblique movement of the follower.

62. The method of claim 58 including adjusting the shoe to different dimensions of shoe channels by substituting followers with different dimensions.

63. The method of claim 58 including forming the follower as a resilient element of the shoe.

64. The method of claim 60 including using a cam with both radial and axial profile surfaces that cause the oblique movement of the follower to the locking position.

65. The method of claim 58 including forming the follower as a portion of the shoe separate from a shoe portion that establishes an axis of rotation for the cam.

66. In a tilt sash counterbalance system having a carrier shoe running vertically in a shoe channel and carrying a rotatable cam engaged by a sash pin to lock the shoe in the shoe channel when the sash tilts, the shoe being formed of a holding component that holds the cam on an axis of rotation and a following component that moves responsively to the cam, the improvement comprising:

the components and the cam being configured so that rotation of the cam within the cam-holding component moves the following component obliquely and diagonally within the shoe and the shoe channel to exert a locking force applied by the following component against one inside corner of the shoe channel and applied by the holding component against a diagonally opposite inside corner of the shoe channel.

67. The improvement of claim 66 wherein the following component is moved by the cam along an inclined surface on the cam-holding component to reach a locking position.

68. The improvement of claim 66 wherein the cam has both radial and axial surfaces that cause the oblique movement of the following component when the cam rotates to move the following component to a locking position.

69. The improvement of claim 66 wherein the following component is a flexible element of the cam-holding component.

70. The improvement of claim 66 wherein the oblique movement of the following component is caused by an axially variable surface of the cam that spreads the components apart in a shoe thickness direction when the sash tilts and a radially variable surface of the cam that shifts the components in a shoe width direction when the sash tilts.

71. A locking shoe combined with a counterbalanced tilt sash and moving vertically with the sash in a shoe channel, the locking shoe having a cam engaged by a pin of the tilt sash, a holder component that holds the cam in a rotatable position, and a follower component that follows a cam profile as the cam rotates, the locking shoe comprising:

the shoe components being arranged so that rotation of the cam when the sash tilts moves the follower component relative to the holder component, the follower component moves obliquely and diagonally within the shoe channel, the follower component is moved beyond a corner of the holder component to extend the shoe in a corner-to-corner diagonal dimension and exert locking pressure applied respectively by the components diagonally between opposite inside corners of the shoe channel.

72. The locking shoe of claim 71 wherein the cam profile includes both radial and axial surfaces that move the follower component.

73. The locking shoe of claim 72 wherein the follower component is formed as a flexible portion of the holder component.

74. The locking shoe of claim 71 wherein the follower component moves along an inclined plane of the holder component.

75. The locking shoe of claim 71 wherein the shoe components and the cam are configured to allow the sash pin to move up out of the shoe and down into the shoe when the shoe is locked.

76. The locking shoe of claim 71 wherein the follower component is made in different dimensions combinable with the holder component to accommodate the shoe to different dimensions of shoe channels.

* * * * *